US012195223B2

(12) United States Patent
Persson

(10) Patent No.: US 12,195,223 B2
(45) Date of Patent: Jan. 14, 2025

(54) DEVICE FOR APPLYING AN ARTICLE TO A MOVING OBJECT

(71) Applicant: Ecolean AB, Helsingborg (SE)

(72) Inventor: Tobias Persson, Kävlinge (SE)

(73) Assignee: Ecolean AB, Helsingborg (SE)

( * ) Notice: Subject to any disclaimer, the term of this patent is extended or adjusted under 35 U.S.C. 154(b) by 0 days.

(21) Appl. No.: 18/260,392

(22) PCT Filed: Dec. 2, 2021

(86) PCT No.: PCT/EP2021/084022
§ 371 (c)(1),
(2) Date: Jul. 5, 2023

(87) PCT Pub. No.: WO2022/152462
PCT Pub. Date: Jul. 21, 2022

(65) Prior Publication Data

US 2024/0059447 A1 Feb. 22, 2024

(30) Foreign Application Priority Data

Jan. 13, 2021 (EP) ..... 21151387

(51) Int. Cl.
*B65B 61/20* (2006.01)

(52) U.S. Cl.
CPC ..... *B65B 61/205* (2013.01)

(58) Field of Classification Search
CPC ..... B65B 61/205; B65B 61/202; B65B 61/20
(Continued)

(56) References Cited

U.S. PATENT DOCUMENTS 4,372,797 A * 2/1983 Dilot ..... B65B 61/205 53/410
4,535,584 A * 8/1985 Tsubota ..... B65B 61/202 198/803.5

(Continued)

FOREIGN PATENT DOCUMENTS

JP 2006-248552 A 9/2006

OTHER PUBLICATIONS

International Search Report Issued Apr. 8, 2022, in PCT/EP2021/084022, filed on Dec. 2, 2021, 3 pages.

*Primary Examiner* — Gloria R Weeks
(74) *Attorney, Agent, or Firm* — Oblon, McClelland, Maier & Neustadt, L.L.P.

(57) ABSTRACT

A device for applying an article to a moving object includes an applicator member having a base element and an arm element. The arm element is telescopically coupled to the base element such that the arm element is movable between a retracted state and an extended state. A biasing member biases the arm element towards its extended state and an actuator shaft is pivotably connected to the base element. The actuator shaft is eccentrically arranged and rotatable about a first rotation axis RA1, and a support member is pivotable about a second rotation axis RA2 and slidingly supports a mid-section of the arm element. An applicator head is cyclically movable between a retrieval position and an application position in response to rotation of the eccentrically arranged actuator shaft about the first rotation axis RA1. The arm element can be brought to its retracted state during movement of the applicator head from the retrieval position to the application position and can assume its extended state during movement of the applicator head from the application position to the retrieval position.

12 Claims, 4 Drawing Sheets

(58) Field of Classification Search
USPC ..... 53/128.1, 133.1
See application file for complete search history.

(56) References Cited

U.S. PATENT DOCUMENTS

| | | | | | |
|---|---|---|---|---|---|
| 4,584,046 | A * | 4/1986 | Geyssel | B65B 61/205 | 156/539 |
| 4,584,819 | A * | 4/1986 | Hakansson | B65B 61/205 | 53/410 |
| 4,669,699 | A * | 6/1987 | Kaneko | B65B 61/205 | 53/133.1 |
| 4,707,965 | A * | 11/1987 | Becker | B65B 61/205 | 53/410 |
| 4,903,458 | A * | 2/1990 | Hakansson | B65D 77/28 | 53/410 |
| 5,037,366 | A * | 8/1991 | Yokoyama | B65B 61/205 | 53/410 |
| 5,463,840 | A * | 11/1995 | Bailer | B65B 61/20 | 53/569 |
| 6,282,865 | B1 * | 9/2001 | Bergstrom | B65B 61/205 | 53/128.1 |
| 6,526,725 | B1 * | 3/2003 | Williams | B65B 61/205 | 493/379 |
| 6,558,490 | B2 * | 5/2003 | Klein | B65C 9/42 | 156/542 |
| 2017/0341793 | A1 * | 11/2017 | Zarur | B65B 57/08 | |
| 2020/0130880 | A1 * | 4/2020 | Männle | B65B 61/207 | |

* cited by examiner

DEVICE FOR APPLYING AN ARTICLE TO A MOVING OBJECT

FIELD OF THE INVENTION

The present invention relates to a device for applying articles to objects, and specifically to a device for applying articles to moving objects.

BACKGROUND ART

A device for applying an article to a moving object, i.e. to an object that is being moved past the device, may be used for applying articles such as drinking straws or labels on objects such as packages.

Objects such as packages may be discharged from a machine such as a filling machine at a high production rate and thus the device for applying articles to the objects discharged from the machine must be capable of matching this high production rate.

One type of device for applying articles to moving objects is known from for instance U.S. Pat. No. 4,584,046 disclosing a device comprising an arm with an applicator head arranged for a reciprocating movement between a retrieval position in which the applicator head retrieves an article and an application position in which the applicator head applies the article to an object. However, such a solution may have difficulties to properly position the article on the object if the object moves too fast.

A solution to this problem is presented in WO2016096380A1 disclosing an apparatus for applying drinking straws to packages. The apparatus comprises a bracket journaled in two eccentric shafts, and by rotation of the shafts, an applicator head of the bracket may be moved along a circular path passing a retrieval position and an application position. The circular path makes it possible for the applicator head to be moved in a direction having a component in the traveling direction of the object such that the applicator head may be moved together with the package for a short while after application of the drinking straw thereby ensuring correct positioning of the drinking straw. Other related background art may be found in US2017/341793A1 and U.S. Pat. No. 4,584,046A.

SUMMARY OF THE INVENTION

In view of that stated above, the object of the present invention is to provide a device for applying an article to a moving object.

It is also an object to provide such a device ensuring accurate positioning of the article on the moving object during high speed production.

To achieve at least one of the above objects and also other objects that will be evident from the following description, a device having the features defined in claim 1 is provided according to the present invention. Preferred embodiments of the device will be evident from the dependent claims.

More specifically, there is provided according to the present invention a device for applying an article, such as a drinking straw or a label, to a moving object, such as a package, the device comprising an applicator member comprising a base element and an arm element, wherein the arm element is telescopically coupled to the base element such that the arm element is movable between a retracted state and an extended state. The device also comprises a biasing member configured to bias the arm element towards its extended state. An actuator shaft is pivotable connected to the base element, wherein the actuator shaft is eccentrically arranged and rotatable about a first rotation axis RA1, and a support member is pivotable about a second rotation axis RA2 and slidingly supports a mid-section of the arm element of the applicator member. A free end of the arm element comprises an applicator head which in response to rotation of the eccentrically arranged actuator shaft about the first rotation axis RA1 is cyclically movable between a retrieval position in which the applicator head is configured for retrieval of the article and an application position in which the applicator head is configured for applying the article to the object. The arm element is configured to be brought to its retracted state during movement of the applicator head from the retrieval position to the application position and configured to assume its extended state during movement of the applicator head from the application position to the retrieval position.

Hereby, a device is provided enabling accurate positioning of an article on a moving object during high speed production.

The applicator member comprises and arm having a base element and an arm element telescopically coupled thereto. The base element is pivotable coupled to a rotatable eccentric shaft and a mid-section of the arm element is slidingly supported by a pivotable support member. Hereby, an applicator head formed by the free end of the arm element is cyclically movable in response to rotation of the actuator shaft between a retrieval position for retrieval of the article and an application position for applying the article to the moving object.

The arm element is movable between an extended state and a retracted state. The arm is biased towards the extended state.

The arm element is further configured to be brought the retracted state during movement of the applicator head from the retrieval position to the application position. The rotation of the actuator shaft causes the applicator head to be cyclically moved between the retrieval position to the application position. The retraction of the arm element during movement of the applicator head from the retrieval position to the application position enables a flattening of the otherwise curved path which the applicator head follows during this movement, enabling a distinct application of the article on the object.

The arm element is also configured to assume its extended state during movement of the applicator head from the application position back to the retrieval position. Consequently, the applicator head may be caused to follow a curved path when being moved towards the retrieval position. The curved path may be so configured that the applicator head directly after application of the article is moved in a direction having a component coinciding with the feeding direction of the moving object, and by matching the rate at which the applicator head is moved along this component in the feeding direction with the feeding rate of the object, it may be ensured that the applicator head for a distance is moved along with the article applied to the object and thus maintains engagement with the article and presses it against the object before being lifted from the article and returned to the retrieval position. Hereby it may be ensured that the article maintain exact positioning on the object after application thereon.

According to one embodiment, the arm element may be configured to be brought from the extended state to the retracted state and then back to the extended state during movement of the applicator head from the retrieval position to the application position such that the applicator head is moved along a near linear path. By configuring the arm element to be brought from the extended state to the retracted state and then back to the extended state during movement of the applicator head from the retrieval position to the application position, the otherwise curved path that the applicator head would follow may be flattened to such an extent that the path becomes near linear, thereby improving the accuracy with which the article may be applied on the moving object.

According to another embodiment, the arm element may be provided with a fixedly arranged projection configured to engage the support member during movement of the applicator head from the retrieval position to the application position. The arm element may be configured to be brought to its retracted state in response to continued rotation of the eccentrically arranged actuator shaft when the projection is brought into engagement with the support member. The arm element is slidingly supported by the support member, and by arranging the projection on arm element, the projection may be brought into engagement with the support member in response to relative movement of the arm element and the support member thereby preventing any further relative movement. When engagement between the projection and the support member has been established, the arm may be brought to its retracted state by means of the telescopic coupling of the arm element with the base element. The projection provided on the arm element may be arranged on a side of the support member facing the base element of the applicator member.

According to yet another embodiment, the projection may be configured to cooperate with the biasing member.

According to yet another embodiment, the arm element may be configured to be maintained in the extended state during movement of the applicator head from the application position to the retrieval position such that the applicator head is moved along a curved path. By maintaining the arm in the extended state, the curved path imposed to the applicator head by the rotation of the actuator head may be fully utilized.

According to yet another embodiment, the biasing member may comprise a spring member.

According to yet another embodiment, the application member may comprise an additional base element and an additional arm element telescopically coupled thereto, wherein the additional base element and the additional arm element extend in parallel with the base element and the arm element.

The applicator head may be arranged for retrieval and application of an article in the form of a drinking straw.

The applicator head may be arranged for applying the article to an object in the form of a package.

The support member may comprise a sliding bearing for supporting the mid-section of the arm element.

Generally, all terms used in the claims are to be interpreted according to their ordinary meaning in the technical field, unless explicitly defined otherwise herein. All references to "a/an/the [element, device, component, means, step, etc]" are to be interpreted openly as referring to at least one instance of said element, device, component, means, step, etc., unless explicitly stated otherwise. The steps of any method disclosed herein do not have to be performed in the exact order disclosed, unless explicitly stated.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for similar elements, wherein.

DESCRIPTION OF EMBODIMENTS

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1:
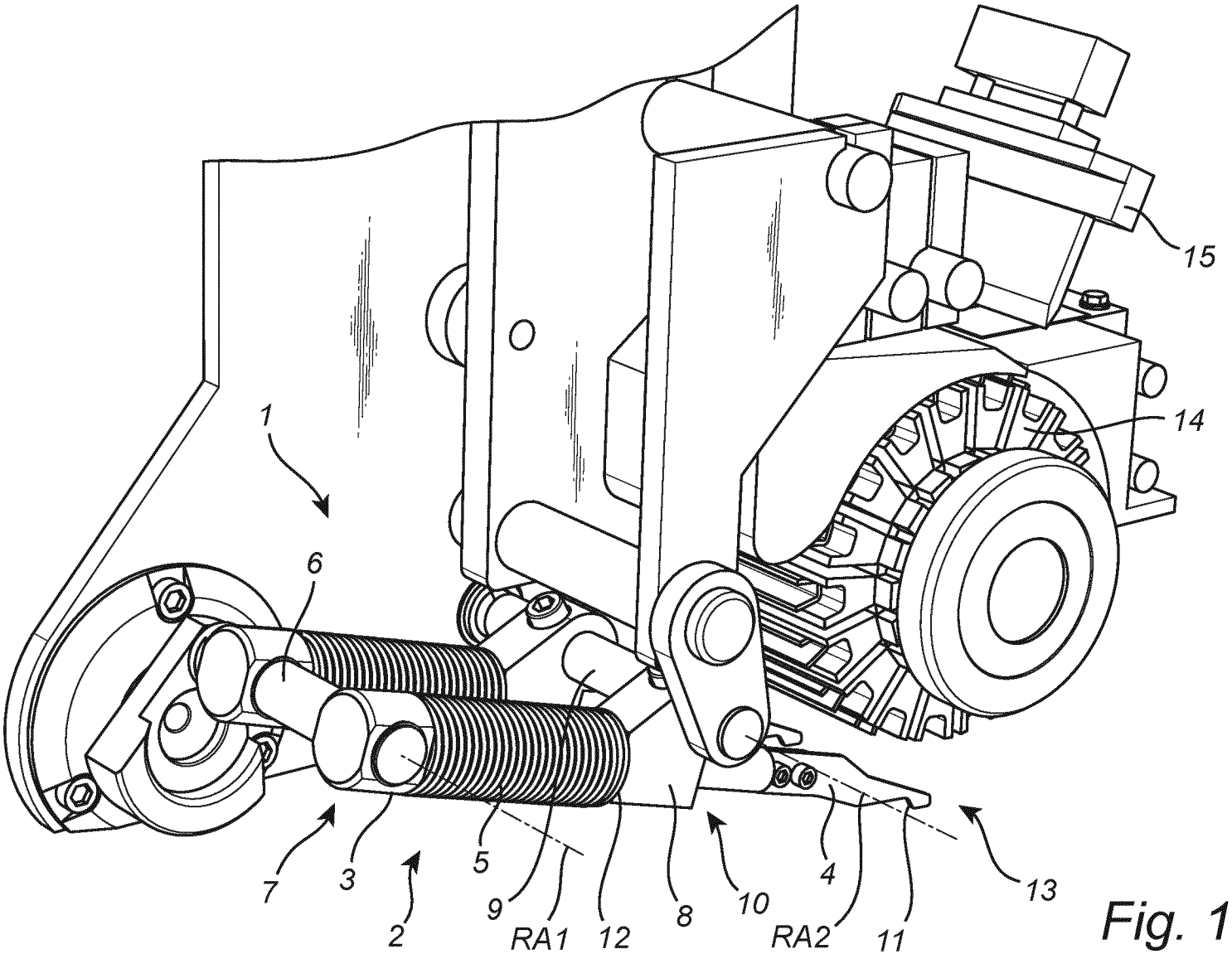
FIG. 1 is perspective view of a device for applying an article to a moving object.

In FIG. 1, is illustrated a device 1 for applying an article to a moving object, i.e. to an object that is moved past the device 1. The object may for instance be moved by means of a conveyor.

The device 1 may be configured for applying articles such as labels or drinking straws on objects such as packages.

The device 1 comprises an applicator member 2 which in the shown embodiment comprises two arms arranged in parallel. It is understood that the applicator member 2 may comprise only one arm or more than two arms.

Each arm comprises a base element 3 and an arm element 4, wherein the arm element 4 is telescopically coupled to the base element 3 such that the arm element 4 is movable between a retracted state and an extended state. In the figure, the arm element 4 is shown in its extended state.

The device 1 further comprises a biasing member 5 which is configured to bias each arm element 4 towards the extended state. In the shown embodiment, the biasing member 5 comprises a spring member.

The application member 2 is pivotable coupled to an actuator. The actuator comprises an actuator shaft 6 which is arranged at a distance from a first rotation axis RA1 and is rotatable about the first rotation axis RA1. Thus, the actuator shaft 6 is eccentrically arranged about the first rotation axis RA1.

The actuator shaft 6 is pivotable connected to the base element 3 of each arm. More specifically, an end portion 7 of each base element 3 is journaled on the actuator shaft 6 such that the arms are pivotable about the actuator shaft 6.

The device 1 further comprises a support member 8 pivotable about a second rotation axis RA2 and arranged to slidingly support the applicator member 2.

The second rotation axis RA2 is arranged in parallel with the first rotation axis RA1.

In the shown embodiment, the support member 8 comprises a support structure for each arm. The support member is journaled about a support shaft 9 extending along the second rotation axis RA2, and thus the support member 8 is rotatable about the second rotation axis RA2.

Each support structure of the support member 8 is configured to slidingly support a mid-section 10 of each arm element 4 of the applicator member 2 and may comprise a sliding bearing configured to slidingly receive the mid-section 10.

The applicator member 2 comprises an applicator head 11 which in response to rotation of the eccentrically arranged actuator shaft 6 about the first rotation axis RA1 is cyclically movable between a retrieval position in which the applicator head 11 is configured for retrieval of the article and an application position in which the applicator head 11 is configured for applying the article to the object.

Each arm element 4 of the applicator member 2 is configured to assume its retracted state during movement of the applicator head 11 from the retrieval position to the application position and is configured to assume its extended state during movement of the applicator head 11 from the application position to the retrieval position.

Each arm element 4 is further provided with a fixedly arranged projection 12 configured to engage the support member 8 during movement of the applicator head 11 from the retrieval position to the application position. The projection 12 of each arm element 4 is arranged on a side of the associated support structure facing the base element 3 telescopically coupled to the arm element 4.

Each arm element 4 is configured to be brought to its retracted state in response to continued rotation of the eccentrically arranged actuator shaft 6 after the projection 12 has been brought into engagement with the associated support structure of the support member 8.

In the shown embodiment, the applicator head 11 is formed by the free end 13 of each arm element 4 and configured for retrieval and application of articles in the form of drinking straws. It is understood that the design of the applicator head is dependent upon the type of article to be retrieved and applied. For instance, the free ends of the arm elements may be interconnected in order to form an applicator head configured for application of articles in the form of labels or other type.

The articles may be supplied from a source. Drinking straws may be provided as a web in which each drinking straw is wrapped in a protective envelope. In the shown embodiment, such a web may be supplied to a drive means 14 in the form of a feed wheel arranged retain the web. A knife 15 is arranged for separation of each enveloped drinking straw from the web. The separated enveloped drinking straws is then advanced one by one to a position associated with the retrieval position of the applicator head 11 of the applicator member 2.

Figure 2:
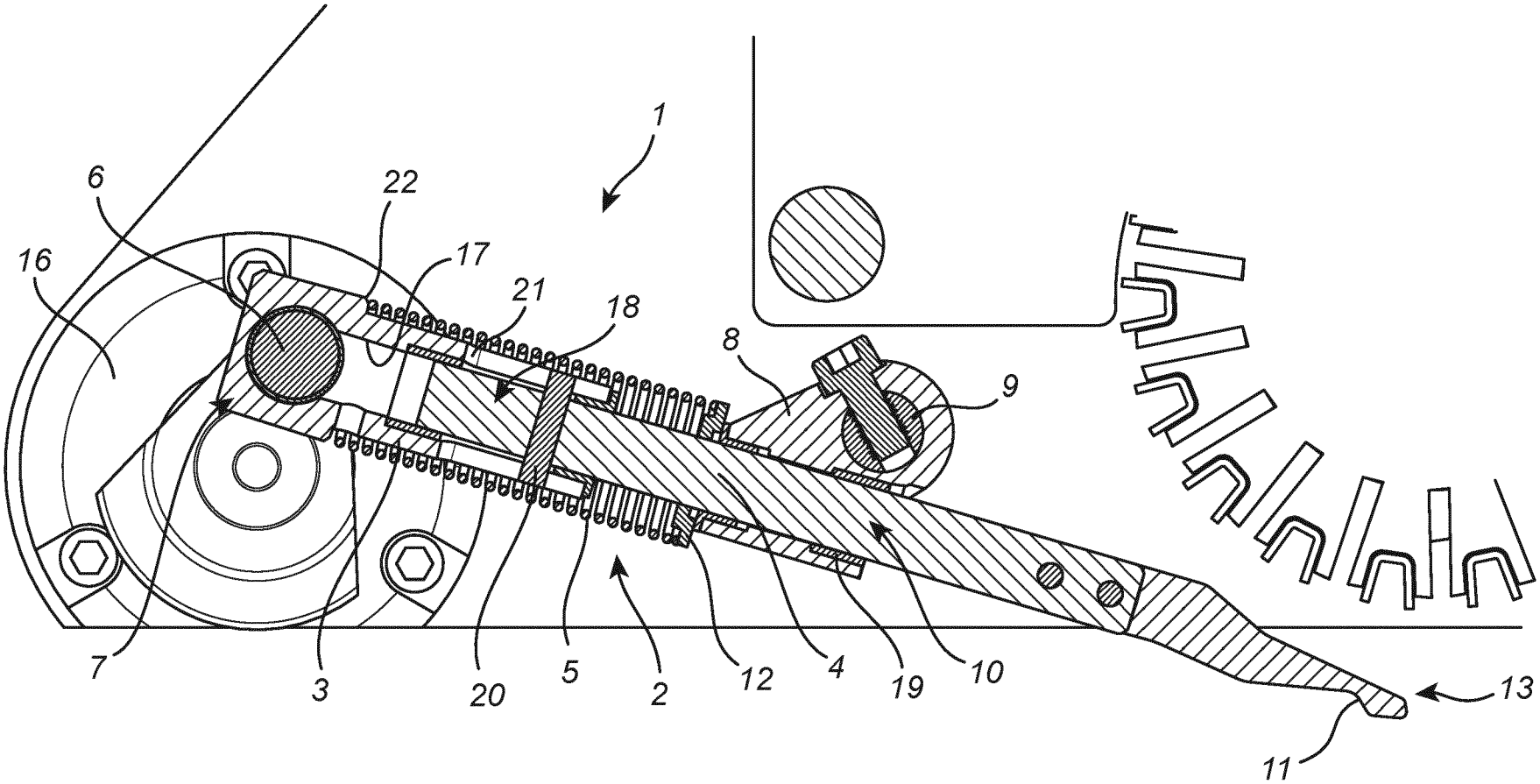
FIG. 2 is a cross sectional view of the device shown in FIG. 1.

The configuration the device 1 and one of the arms of the applicator member 1 is more clearly shown in FIG. 2, to which reference now also is made.

The device 1 comprises rotatable actuator wheel 16 eccentrically supporting the actuator shaft 6 at a distance from the first rotation axis RA1. The actuator wheel 16 may be rotated by a not shown motor, such as a servo motor.

The end portion 7 of the base element 3 is journaled in the actuator shaft 6 and thus pivotably relative the actuator shaft 6.

The base element 3 defines a cavity 17 extending in the longitudinal direction of the arm.

An end portion 18 of the arm element 4 is slidingly received by the cavity 17 such that the arm element 4 is telescopically coupled to the base element 3 and movable between the retracted state and the extended state.

The support structure of the support member 8 is pivotable about the second rotation axis RA2 arranged in parallel with the first rotation axis RA1.

The support structure comprises a sliding bearing 19 slidingly supporting the mid-section 10 of the arm element 4.

In the shown embodiment, a pin 20 extends transversely through the end portion 18 of the arm element 4. The opposing ends of the pin 20 is received by two oppositely arranged long holes 21 provided in the base element 3 and extending in the longitudinal direction of the arm. Thus, the retracted state and the extended state of the arm element 4 are defined by means of the pin 20 and the long holes 21.

The projection 12 is arranged on the arm element 4 on the side of the support structure facing the base element 3. In the shown embodiment, the projection 12 is the form of a washer.

The arm of the applicator member 2 comprises a biasing member 5 in the form of a spring element configured for biasing the arm element 4 towards its extended state. In the shown embodiment, the spring element is arranged between a heel 22 provided on the base portion 3 and the projection 12 in the form of a washer.

Figure 3:
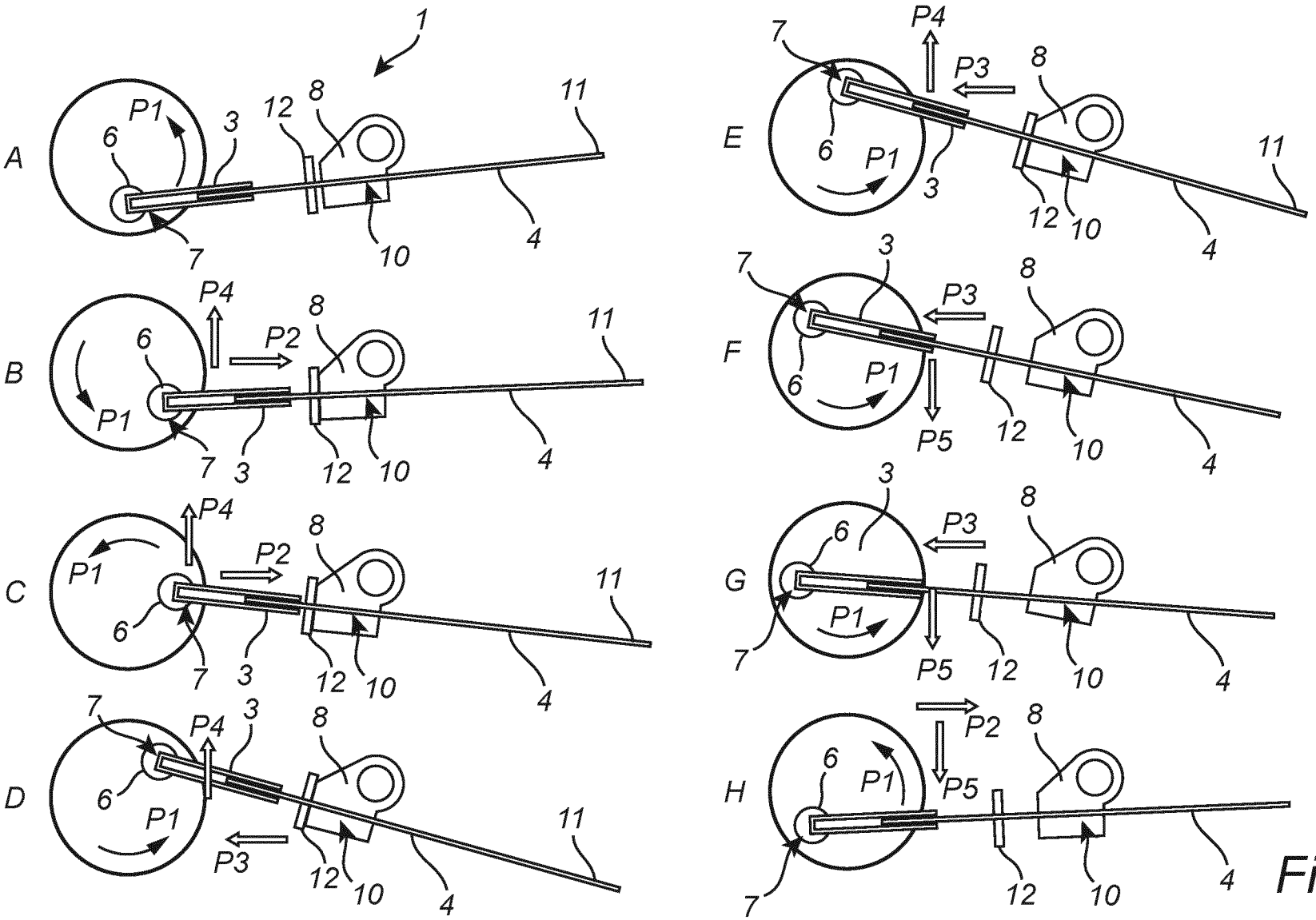
FIG. 3 is a schematic view illustrating the operation of the device.

The operation of the device will now be discussed with reference to FIG. 3 illustrating the device 1 in positions A-H.

By continuous rotation of the actuator shaft 6 trough positions A-H, the angle of the arm of the applicator member will be cyclically changed, and the pivotable support member 8 slidingly supporting the mid-section 10 of the arm element will help accommodating these changes of the angle of the arm.

In position A, the arm element 4 is in its extended state and the applicator head 11 is in its retrieval position.

By rotation of the actuator shaft 6 in an anti-clock wise direction indicated by arrow P1, the device 1 will initially move from position A to positions B and C causing the base element 3 pivotable coupled to the actuator shaft 6 to be moved in a first lateral direction indicated by arrow P2 while the end portion 7 of the base element 3 is moved in a first transverse direction indicated by arrow P4.

Movement of the base element 3 in the first lateral direction P2 will cause the projection 12 provided on the arm element 4 telescopically coupled to the base element 3 to be brought into engagement with the support member 8, preventing the arm element 4 to be pushed through the support member 8 slidingly supporting the mid-section 10 of arm element 4, i.e. the arm element 4 can no longer be moved together with the base element 3 in the first lateral direction P1. Instead, the end portion 18 of the arm element 4 will be pushed deeper into the cavity of the base element 3—as shown in position B and C—against the action of the biasing member.

In position C, the arm element 4 has assumed its fully retracted state.

By continued rotation of the actuator shaft 6 in the anti-clock wise direction P1 through positions D and E, the base element 3 pivotable coupled to the actuator shaft 6 will be moved in a second lateral direction indicated by arrow P3, which is opposite to the first lateral direction P2, while the end portion 7 of the base element 3 being continuously moved in the first transverse direction P4, whereby the arm element 4 is extended through the action of the biasing member while the projection 12 maintains its engagement with the support member 8.

In position E, the arm element 4 has once again reached its fully extended state and the applicator head 11 has reached the application position.

Thus, when the device 1 is operated through positions A-E, the applicator head 11 is moved from the retrieval position to the application position and simultaneous the arm element 4 is caused to being moved from the extended state to the retracted state (positions A-C) and back to the extended state (positions C-E). As a consequence, the applicator head 11 may be caused to be moved along a near linear path when being moved from the retrieval position to the application position.

By continued rotation of the actuator shaft 6 in the anti-clock wise direction P1 through positions E-H, the base element 3 will initially (positions E-G) be moved in the second lateral direction P3 while the end portion 7 of the base element 3 is moved in a second transverse direction indicated by arrow P5, which is opposite to the first transverse direction P4, with the arm element 4 in its fully extended state. During this movement, the projection 12 will be brought out of engagement with the support member 8, and thus the arm element 4 will maintain its fully extended state under the action of the biasing member.

By continued rotation of the actuator shaft 6 (positions G-H and then back to position A) the base element 3 will be moved in the first lateral direction P2 while the end portion 7 is continuously moved in the second transverse direction P5. During this movement, the projection 12 will be moved towards the support member 8 but will not be brought into engagement with the same and, thus, the arm element 4 will maintain its fully extended state.

In position A, the arm element 4 is in its extended state and the applicator head 11 has regained its retrieval position.

As the arm element 11 maintains its fully extended state through positions E-A, the applicator head 11 will be moved along a curved path from the application position back to the retrieval position.

Figure 4:
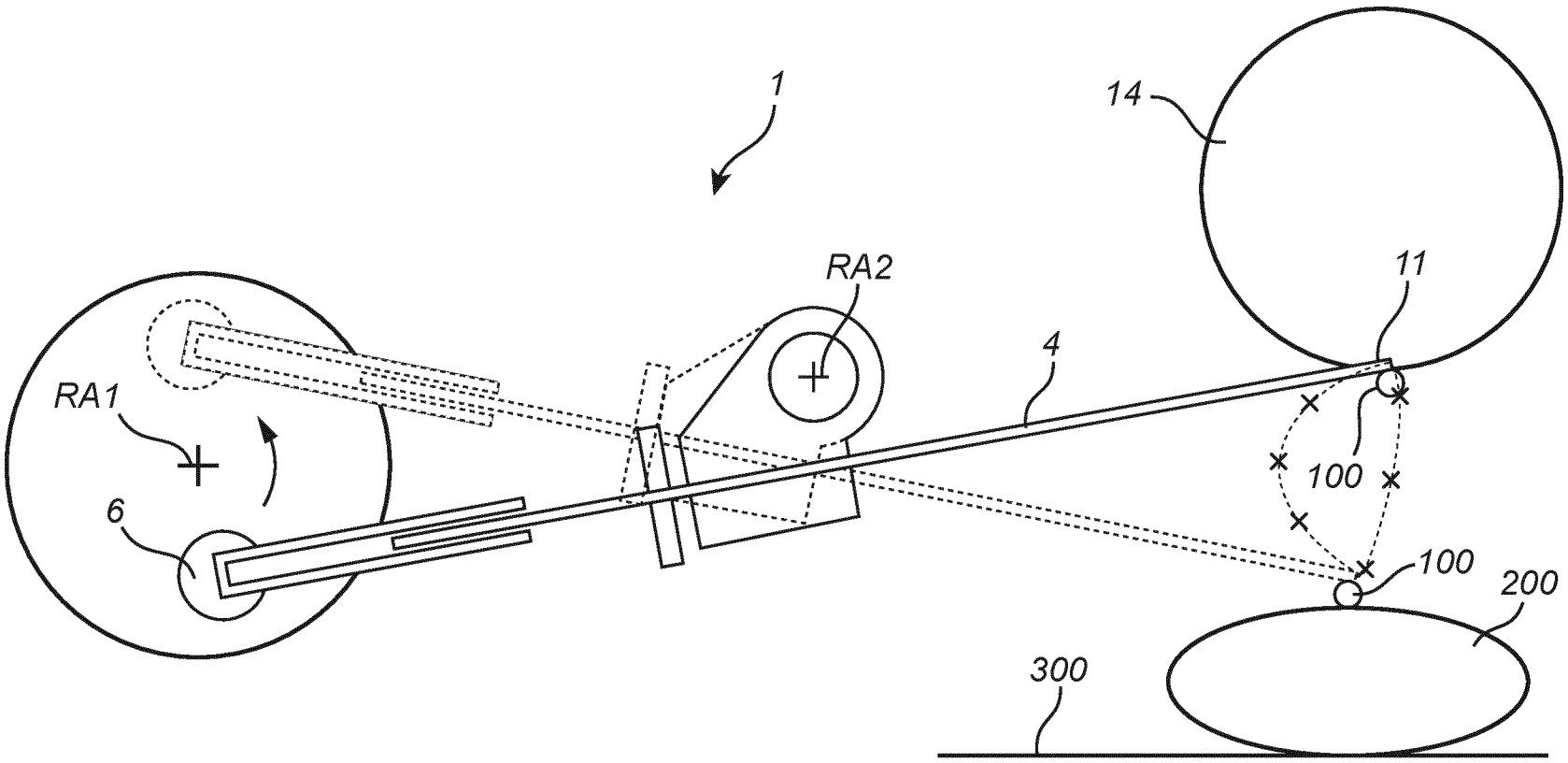
FIG. 4 is a schematic view of the device showing an applicator head in a retrieval position and an application position, respectively.

FIG. 4 schematically illustrates the use of the device 1 for applying an article 100 on a moving object 200. The article 100 may be a drinking straw and the object 200 may be a package. The object is moved on a conveyor 300 in a feeding direction indicated by arrow P6.

The figure illustrates the device 1 with its applicator head 11 in the retrieval position. The figure also indicates by dashed lines the device 1 with its applicator head 11 in the application position.

The figure further illustrates a drive means 14 in the form of a feed wheel which has advanced the article 100 to a position associated with the retrieval position of the applicator head 11 such that the applicator head 11 may retrieve the article 100 from the drive means.

By rotation of the actuator shaft 6 about the first rotation axis RA1 from position A to position E as illustrated in FIG. 3, the applicator head 11 is moved from the retrieval position to the application position. Due to the retraction and subsequent extension of the applicator arm 4 during this movement, the applicator head 11 will be caused to follow a near linear path allowing a distinct application of the article 100 on the object 200.

The article 100 may be applied to an application surface of the object 200 having been provided with an adhesive, such as hot melt, at an up stream situated station.

By continued rotation of the actuator shaft 6 about the first rotation axis RA1 from position E back to position A as indicated in FIG. 3, the applicator head 11 is moved from the application position back to the retrieval position, during which movement the arm element 4 is in its extended state and thus, the applicator head 11 will be caused to follow a curved path which initially has a component in the feeding direction P6 of the moving object 200.

By matching the rate at which the applicator head is moved along this component in the feeding direction P6 with the feeding rate of the object 200, it will be possible for the applicator head 11 to maintain engagement with the article 100 and to press it against the object 200 after the application of the article 100 before being lifted and moved back to the retrieval position.

The movement of the applicator head 11 along the near linear path and the curved path is indicated by dashed lines in the figure.

It will be appreciated that the present invention is not limited to the embodiments shown. Several modifications and variations are thus conceivable within the scope of the invention which thus is exclusively defined by the appended claims.

The invention claimed is:

1. A device for applying an article, such as a drinking straw or a label, to a moving object, such as a package, the device comprising:

an applicator member comprising a base element and an arm element, wherein the arm element is telescopically coupled to the base element such that the arm element is movable between a retracted state and an extended state, a biasing member configured to bias the arm element towards its extended state, an actuator shaft pivotable connected to the base element, wherein the actuator shaft is eccentrically arranged and rotatable about a first rotation axis RA1, and a support member which is pivotable about a second rotation axis RA2 and slidingly supports a mid-section of the arm element of the applicator member, wherein a free end of the arm element comprises an applicator head which in response to rotation of the eccentrically arranged actuator shaft about the first rotation axis RAI is cyclically movable between a retrieval position in which the applicator head is configured for retrieval of the article and an application position in which the applicator head is configured for applying the article to the object, wherein the arm element is configured to be brought to its retracted state during movement of the applicator head from the retrieval position to the application position, and wherein the arm element is configured to assume its extended state during movement of the applicator head from the application position to the retrieval position.

2. The device according to claim 1, wherein the arm element is configured to be brought from the extended state to the retracted state and then back to the extended state during movement of the applicator head from the retrieval position to the application position such that the applicator head is moved along a near linear path.

3. The device according to claim 1, wherein the arm element is provided with a fixedly arranged projection configured to engage the support member during movement of the applicator head from the retrieval position to the application position.

4. The device according to claim 3, wherein the arm element is configured to be brought to its retracted state in response to continued rotation of the eccentrically arranged actuator shaft when the projection is brought into engagement with the support member.

5. The device according to claim 3, wherein the projection provided on the arm element is arranged on a side of the support member facing the base element of the applicator member.

6. The device according to claim 3, wherein the projection is configured to cooperate with the biasing member.

7. The device according to claim 1, wherein the arm element is configured to be maintained in the extended state during movement of the applicator head from the application position to the retrieval position such that the applicator head is moved along a curved path.

8. The device according to claim 1, wherein the biasing member comprises a spring member.

9. The device according to claim 1, in which the application member comprises an additional base element and an additional arm element telescopically coupled thereto, wherein the additional base element and the additional arm element extend in parallel with the base element and the arm element.

10. The device according to claim 1, wherein the applicator head is arranged for retrieval and application of an article in the form of a drinking straw.

11. The device according to claim 1, wherein the applicator head is arranged for applying the article to an object in the form of a package.

12. The device according to claim 1, wherein the support member comprises a sliding bearing for supporting the mid-section of the arm element.

* * * * *